United States Patent [19]

Freeman et al.

[11] 3,954,267

[45] May 4, 1976

[54] AIR POWERED HOCKEY GAME AND PUCK THEREFOR

[75] Inventors: Richard Freeman, South Windsor; Norbert L. Reiner, Wallingford, both of Conn.

[73] Assignee: Coleco Industries, Inc., Hartford, Conn.

[22] Filed: Feb. 10, 1975

[21] Appl. No.: 548,629

[52] U.S. Cl. ..... 273/126 A; 273/128 R

[51] Int. Cl.[2] ..... A63F 3/00

[58] Field of Search ..... 273/126 R, 126 A, 128 R, 273/128 CS, 185 D

[56] References Cited

UNITED STATES PATENTS

| | | | |
|---|---|---|---|
| 2,159,966 | 5/1939 | Dunham | 273/126 R |
| 3,452,990 | 7/1969 | Nichols | 273/185 D |
| 3,773,325 | 11/1973 | Crossman | 273/126 A |

FOREIGN PATENTS OR APPLICATIONS

| | | | |
|---|---|---|---|
| 189,301 | 11/1922 | United Kingdom | 273/126 R |
| 208,621 | 12/1923 | United Kingdom | 273/126 R |

*Primary Examiner*—Richard C. Pinkham
*Assistant Examiner*—T. Brown

[57] ABSTRACT

Improved action is provided in an air powered game wherein the puck glides on a cushion of air by providing the puck with an annular bumper member of resiliently deformable resin to impact and resiliently rebound from the side boundaries of the playing surface. The puck is comprised of a body member of rigid resin providing an upstanding circular wall and an annular shoulder thereabout. The annular bumper member seats about the circular wall on the annular shoulder and projects outwardly of the periphery of the body member. The game table surface is provided with a pattern of spaced perforations through which air escapes and the puck is dimensioned and configured to provide a recess in its bottom surface which will overlie sufficient of the perforations as to be subjected to air streams effectively overcoming the weight of the puck member and thus providing minimal frictional surface resistance to movement of the puck member.

6 Claims, 5 Drawing Figures

AIR POWERED HOCKEY GAME AND PUCK THEREFOR

BACKGROUND OF THE INVENTION

For many years, it has been proposed to provide air tables which would provide a bed or cushion of air upon which a puck would move effectively without friction. Illustrative of such air tables are Williams U.S. Pat. Nos. 3,415,478 and 3,429,544 granted Dec. 10, 1968 and Feb. 25, 1969 respectively. It has also long been known to provide hockey games wherein opposing players would propel a puck towards the opposing goal across the table surface such as for example illustrated in Dennison U.S. Pat. No. 3,228,688 granted Jan. 11, 1968. Heretofore, it has been suggested to use air for propelling game pieces as for example in Pflugmann U.S. Pat. No. 3,066,937 granted Dec. 4, 1962 and Bayha U.S. Pat. No. 3,367,658 granted Feb. 6, 1968.

Recently, there has developed considerable market interest in hockey and like games which would combine the relatively frictionless movement of the puck disclosed in the Williams patents across an air table while opposing contestants attempted to direct that puck into a goal. Illustrative of this type of device are the hockey game illustrated in Crossman et al. U.S. Pat. No. 3,773,325 granted Nov. 20, 1973 and the curling game illustrated in Ducharme U.S. Pat. No. 3,722,888 granted Mar. 27, 1973. In the latter patent, one embodiment discloses the use of a resiliently deformable boundary wall provided by elastic bands to return the puck rapidly from the side surface of the game board. Generally, there has been a continuing desire to increase the rapidity of game action not only in the air powered games of the type discussed above but also in various other games involving contestant reflexes.

There have been disclosed various composite playing pieces in connection with different types of games in order to facilitate varied or improved play action. Illustrative of such composite game pieces are those illustrated in:

| U.S. Patent | Granted | Patentee |
|---|---|---|
| 2,494,929 | 1/17/50 | Colalucia |
| 2,606,030 | 8/5/52 | Tjomsland |
| 2,812,184 | 11/5/57 | McGee |
| 3,206,210 | 9/14/65 | Bard |
| 3,310,307 | 3/21/67 | Brown |
| 3,610,625 | 10/5/71 | Erno |
| 3,675,928 | 7/11/72 | Gentile |
| 3,726,526 | 4/10/73 | Radovich |
| 3,784,204 | 1/8/74 | Felber |
| 3,797,057 | 3/19/74 | Smelden |
| 3,851,880 | 12/3/74 | Ritch |

However, there has heretofore been no game puck for an air powered table which would provide a combination of resilient rebound characteristics and effectively friction-free movement over the playing surface with the puck being adapted to provide varied and rapid game action.

It is an object of the present invention to provide a novel puck for use in air powered games wherein the puck rebounds rapidly from the margins of the playing surface to provide rapid and diverse game action.

It is also an object to provide such a puck wherein a controlled spin may be imparted to the puck so as to produce unusual rebound movements from the side margins of the game board.

Another object is to provide such a puck which may be fabricated relatively simply and economically from synthetic resins.

A further object is to provide an air powered game employing the novel puck described above and affording diverse and rapid game rebounding action.

SUMMARY OF THE INVENTION

It has now been found that the foregoing related objects may be readily attained in a puck comprising a body member of relatively rigid synthetic resin and generally circular cross section. The body member has a transverse bottom wall with a coaxial circular recess extending upwardly in the lower surface thereof and an upstanding circular wall extending upwardly from the upper surface of the transverse wall. This circular wall is spaced inwardly from the periphery of the transverse wall so as to provide an annular shoulder thereabout. Seated about the circular wall on the annular shoulder is an annular bumper member of resiliently deformable synthetic resin. The bumper member is of a width greater than the width of the annular shoulder so that it projects outwardly of the periphery of the body member for engagement with the side surface of an associated game table.

In the preferred embodiment, the upstanding circular wall is provided by a ring-shaped member and the annular bumper member projects outwardly of the bumper member a distance of at least one-eighth inch. The bumper member preferably employs a deformable resin having a durometer of about 32–45 on the Short A Scale. To minimize weight and faciliate rebound action, the annular bumper member has an inwardly beveled surface about the upper portion of the outside surface thereof. To resist inadvertent disassembly, the annular bumper member is of smaller inner diameter than the outer diameter of the circular wall, thereby resiliently bearing thereon.

In assembly, the puck is used in connection with a game table having a planar playing surface and boundary walls extending thereabout of relatively rigid material. The planar playing surface has a pattern of closely spaced perforations therein and the game table includes means for supplying air under pressure and conduit means communicating with the perforations to provide jets of air issuing therefrom. The puck recess is dimensioned to overlie a multiplicity of the game table perforations and thereby entrap air issuing therefrom to offset the combined weight of the body member and annular bumper member. In this fashion, the puck member slides essentially frictionlessly on the playing surface and resiliently rebounds from the boundary walls upon impact thereagainst.

BRIEF DESCRIPTION OF THE ATTACHED DRAWINGS

DETAILED DESCRIPTION OF THE DETAILED EMBODIMENT

Figure 1:
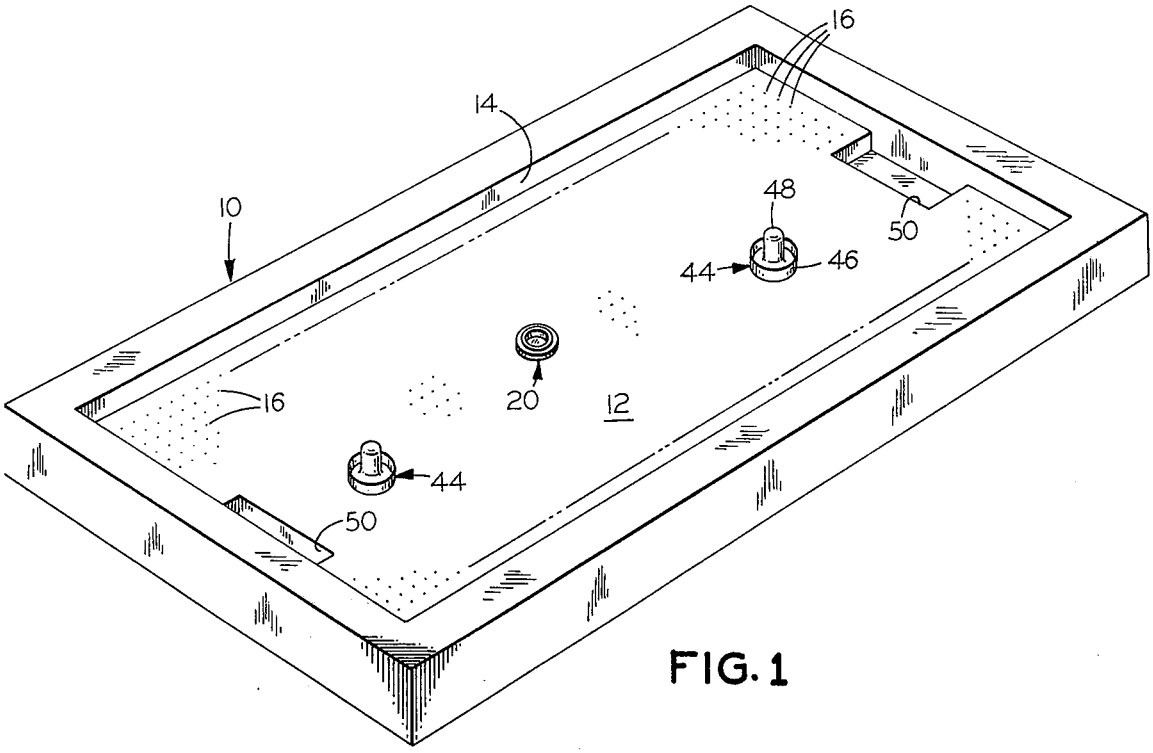
FIG. 1 is a fragmentary perspective view of a game table assembly employing the novel puck of the present invention.
Figure 2:
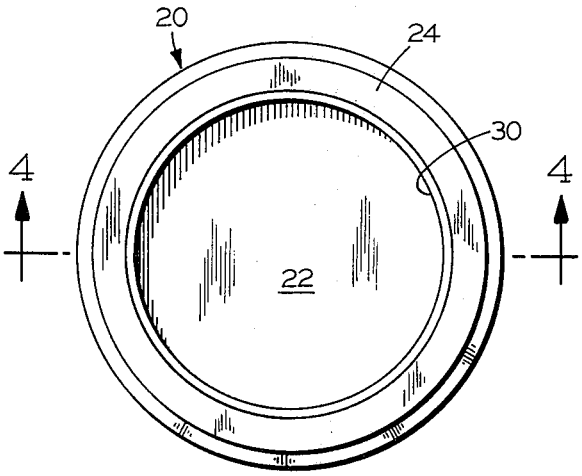
FIG. 2 is a top view to an englarged scale of the puck of FIG. 1.
Figure 3:
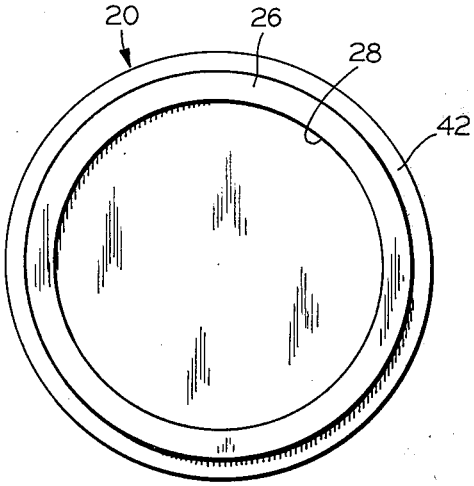
FIG. 3 is a bottom view of the puck.
Figure 4:
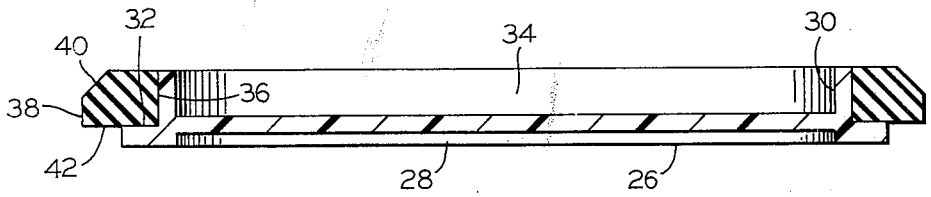
FIG. 4 is a sectional view along the line 4—4 of FIG. 2 to an enlarged scale.
Figure 5:
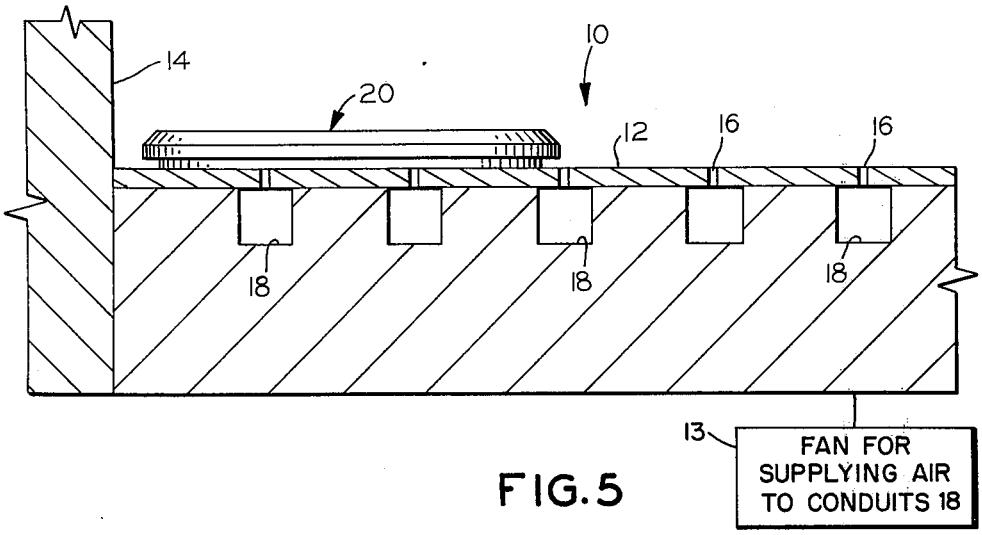
FIG. 5 is a cross section view of the game table assembly showing the puck after impacting upon the boundary wall of the game table.

Turning first to FIGS. 1 and 5 of the attached drawings, a game table assembly embodying the present invention includes a game table generally designated by the numeral 10 having a generally rectangular playing surface 12 bounded by a sidewall 14 of relatively rigid material. As best seen in FIG. 5, the playing surface 12 has a multiplicity of perforations 16 therein over substantially the entire playing surface, and air from a fan or like source 13 is fed into the conduits 18 and is discharged through the perforations over the playing surface 12 of the game table 10.

Slidable on the playing surface 12 is a puck generally designated by the numeral 20 and comprised of a body member 22 of generally circular cross section and a bumper member 24 of generally annular cross section. The body member 22 is integrally formed from a relatively rigid synthetic resin with a transverse bottom wall or disc portion 26 having a generally circular recess 28 in the lower surface thereof. Extending upwardly from the upper surface of the transverse wall 26 is a ring-shaped wall 30 of lesser diameter than the width of the transverse wall 26 so as to provide an annular shoulder 32 thereabout and a relatively deep circular cavity 34 therewithin.

The bumper member 24 is a generally annular configuration with a substantially vertically extending inner wall 36 and an outer wall which includes a vertically extending lower portion 38 and an inwardly and upwardly bevelled or chamfered top portion 40. The diameter of the inner wall 36 of the bumper member 24 is less than the outer diameter of the ring-shaped wall 30 so that the bumper member 24 must be snapped thereover and will resiliently bear there against so as to retain the members in assembly. The lower surface 42 of the bumper member 24 seats substantially on the annular shoulder 32 and the outer circumferential portion of the bumper member 24 projects outwardly beyond the periphery of the bottom wall 26 of the body member 22 so that it will come into contact with the sidewall 14 of the game table 10.

In the illustrated embodiment of the game table assembly, the puck 20 is propelled by the player by use of a "stick" or "bat" generally designated by the numeral 44 and comprising a disc-shaped base portion 46 and an upwardly projecting coaxially extending handle portion 48. In play, the stick 44 is brought sharply against the puck 20 and, upon impact, transfers substantial momentum thereto. If the stick 44 is given a twisting motion at the time of impact with the puck 20, it will tend to impart a rapid spin thereto in addition to linear sliding movement, the tacky surface of the bumper member 24 tending to provide the frictional gripping therebetween necessary to effect the transfer of the rotational component.

Upon impact with the sidewall 14 bounding the playing surface 12, the puck 20 will rebound therefrom. The relatively resilient nature of the bumper member 24 actually imparts enhanced rebounding action. In addition, if a spin component has been imparted to the puck 20, the puck will not rebound at what would be the natural angle of incidence but rather at a diverse angle, thus providing a measure of unexpected and unpredictable movement. The players attempt to propel the puck 20 into the goal 50 of the opposing player.

The puck is fabricated as a two piece member from resins of differing rigidity. The body member is fabricated from a resin of relatively rigid character although one which is impact resistant so as to be able to absorb the many impacts occurring during the play of the game over the useful life thereof. Among the resins that may be employed for this purpose are acrylonitrite/-butadiene/styrene interpolymers, polycarbonates, polyamides and polyacetals. In addition, there may be employed filled polymers and glass reinforced polymers.

The resin employed for the bumper member must be one providing both long life and the desired resiliency. Among the many resilient polymers that may be used are butadiene/styrene block copolymers, ethylene/vinyl acetate copolymers, polybutadiene rubbers, polyisoprene rubbers and ethylene/propylene terpolymers. The durometer of the resin is on the order of 32–45 on the Shore A Scale and is preferably about 35–42.

The game table may be fabricated from various materials depending upon the desired cost of construction. In the illustrated embodiment, the base of the playing field is provided by a composite structure including a body portion with routed channels therein and a cover member of pressed wood having the necessary perforations therein. Molded synthetic resin structures may be employed for the same purpose and other techniques can be utilized for providing the desired air channels therein. The sidewall or boundary wall for the playing field should be relatively rigid, and wood or other rigid plastics are conveniently used for this purpose.

The sticks or bats used to propel the pucks should be made from materials which are resistant to impact and long lived. Generally speaking, the same resins as employed for the body member of the puck will prove satisfactory although other materials of construction may be employed including wood and metal.

The body member of the puck may differ in configuration from that illustrated so long as it provides a recess in its bottom surface for capturing air and an annular shoulder for seating the bumper member. For example, the ring-like member providing the annular wall onto which the bumper is snapped may be considerably shallower than illustrated and in fact the cavity defined by this wall may be omitted depending upon the weight of the piece. Moreover, the body member itself may be a composite structure utilizing both impact resistant materials and foam materials to reduce the weight thereof.

It will be appreciated that the configuration of the bumper member may deviate from that illustrated. Although the outer surface may be convex, it has been found considerably more advantageous to provide a linearly vertically extending surface portion to spread the impact over a wider surface area and to facilitate the imparting of rotational spin. The chamfered or bevelled upper portion allows the removal of material where not required to reduce weight and at the same time ensures an adequate volume of material and projection for the desired game action. The bumper member should project outwardly of the body member a distance of one-eighth inch and preferably 3/16 to three-eighths inch.

The recess in the bottom surface of the body member of the puck is of considerable significance and must be dimensioned to bridge enough perforations in the playing surface so as to ensure entrapment of a volume of air adequate to offset the weight of the composite puck. Both diameter and depth are significant in this regard although the diameter is the principal controlling factor. In practice, using perforations spaced one inch on center in the playing surface, the puck body member has a maximum diameter of about 2½ to 3½ inches and the recess has a diameter of 2 to 2¾ inches. The recess itself has a depth of about 0.025–0.075 inch and preferably about 0.035–0.055 inch.

As a specific example of the dimensions for a highly satisfactory puck, the following are provided. The body member has a bottom wall diameter of 2.6 inches and the recess in the bottom surface has a diameter of 2.3 inches with a depth of 0.045 inch. The overall height of the body member including the ring-shaped wall is 0.25 inch and the outer diameter of the ring-shaped wall is 2.3 inches. The bumper member has an outer diameter of 2.8 inches and an inner diameter of 2.2 inches with an overall height of 0.2 inch.

Thus, it can be seen from the foregoing detailed description and drawings that the present invention provides a novel puck for air powered games which will rebound rapidly from the margins of the playing surface to provide rapid and diverse game action. The puck is such that a controlled spin may be imparted thereto to produce unusual rebound movements and the components of the puck may be fabricated simply and relatively inexpensively from synthetic resins.

Having thus described the invention, we claim:

1. A game providing rapid and diverse game action comprising:

a. a game table having a planar playing surface and boundary walls extending thereabout of relatively rigid material, said planar playing surface having a pattern of closely spaced perforations therein, said game table further including means for supplying air under pressure and conduit means communicating with said perforations to provide jets of air issuing from said perforations; and b. a puck comprising:

1. a body member of relatively rigid synthetic resin and generally circular cross section having a continuous disc portion with upper and lower surfaces and with a coaxial circular recess extending upwardly in the lower surface thereof and upstanding annular wall extending upwardly from the upper surface of said disc portion and spaced inwardly from the periphery thereof to provide a horizontally disposed annular shoulder thereabout and a cavity therewithin, said annular wall having substantially vertical faces; and 2. an annular bumper member of resiliently deformable synthetic resin seated about said annular wall and on said annular shoulder, said annular bumper member being of a width greater than the width of said shoulder so as to project outwardly of the periphery of said body member for engagement with the boundary walls of said game table, said puck recess being dimensioned to overlie a multiplicity of said game table perforations and thereby entrap air issuing therefrom to offset the combined weight of said body member and annular bumper member, whereby said puck member will slide essentially frictionlessly on said playing surface and will resiliently rebound from said boundary walls upon impact thereagainst.

2. The puck in accordance with claim 1 wherein said resiliently deformable resin of said annular bumper member has a durometer of about 32–45 on the Shore A Scale.

3. The puck in accordance with claim 1 wherein said annular bumper member is provided with an inwardly beveled surface about the upper portion of the outside surface thereof.

4. The game in accordance with claim 1 wherein said annular bumper member projects outwardly of said body member a distance of at least one-eighth inch.

5. The game in accordance with claim 1 wherein said body member recess has a depth of 0.035–0.055 inch.

6. The game in accordance with claim 1 wherein said annular bumper member is of smaller inner diameter than the outer diameter of said annular wall so as to resiliently bear thereon and resist inadvertent disassembly therefrom.

* * * * *